US011365871B2

(12) United States Patent
Laliberte

(10) Patent No.: US 11,365,871 B2
(45) **Date of Patent: *Jun. 21, 2022**

(54) HUMAN TRACKING TO PRODUCE IMPROVED JOBSITE LIGHTING

(71) Applicant: Robert Bosch GmbH, Stuttgart (DE)

(72) Inventor: Eric R. Laliberte, Naperville, IL (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/163,846

(22) Filed: Feb. 1, 2021

(65) Prior Publication Data

US 2021/0310643 A1 Oct. 7, 2021

Related U.S. Application Data

(63) Continuation of application No. 16/840,668, filed on Apr. 6, 2020, now Pat. No. 10,935,222.

(51) Int. Cl.

| | |
|---|---|
| ***F21V 21/14*** | (2006.01) |
| ***F21V 21/26*** | (2006.01) |
| ***F21V 23/04*** | (2006.01) |
| ***F21W 131/10*** | (2006.01) |

(52) U.S. Cl.

CPC ..... *F21V 21/145* (2013.01); *F21V 21/26* (2013.01); *F21V 23/045* (2013.01); *F21V 23/0471* (2013.01); *F21V 23/0478* (2013.01); *F21V 23/0485* (2013.01); *F21W 2131/1005* (2013.01)

(58) Field of Classification Search

CPC ..... F21V 21/145; F21V 21/14; F21V 21/15; F21V 23/045; F21V 23/0471; F21V 23/0478; F21V 23/0485; F21V 23/0442

See application file for complete search history.

(56) References Cited

U.S. PATENT DOCUMENTS

| | | | |
|---|---|---|---|
| 6,079,862 | A | 6/2000 | Kawashima et al. |
| 6,324,453 | B1 | 11/2001 | Breed et al. |
| 6,474,844 | B1 | 11/2002 | Ching |

(Continued)

FOREIGN PATENT DOCUMENTS

| | | | |
|---|---|---|---|
| DE | 94 09 880 | U1 | 9/1994 |
| DE | 102 14 227 | A1 | 10/2003 |

(Continued)

OTHER PUBLICATIONS

New Milwaukee Power Tools coming in 2019, https://www.youtube.com/watch?v=qZskk_qu2oQ&feature=youtu.be, accessed and available as of Apr. 6, 2020.

*Primary Examiner* — William N Harris

(74) *Attorney, Agent, or Firm* — Maginot, Moore & Beck LLP

(57) ABSTRACT

A portable work light is disclosed having a light fixture with one or more rotational degrees of freedom that are automatically actuated such that a light thereof can maintain optimal lighting for a target person in a jobsite environment. Particularly, the portable work light is advantageously configured to track a target person's location within the jobsite environment and automatically reorient the light fixture as needed to maintain optimal illumination of the jobsite for the target person. In this way, the non-value-added work of repositioning or reorienting the work light is eliminated, thus enhancing the productivity of the target person at the jobsite.

20 Claims, 3 Drawing Sheets

(56) References Cited

U.S. PATENT DOCUMENTS

| | | | | |
|---|---|---|---|---|
| 10,062,258 | B2 | 8/2018 | Siminoff et al. | |
| 10,517,158 | B2 | 12/2019 | Hallack et al. | |
| 10,677,449 | B1 * | 6/2020 | Cui | F21V 23/0478 |
| 2008/0186720 | A1 | 8/2008 | Verbrugh | |
| 2010/0213849 | A1 | 8/2010 | Chien | |
| 2013/0155672 | A1 | 6/2013 | Vo et al. | |
| 2016/0249164 | A1 | 8/2016 | Jovicic | |
| 2017/0055328 | A1 * | 2/2017 | Law | F21V 23/0471 |
| 2017/0265280 | A1 * | 9/2017 | Setomoto | F21V 21/14 |
| 2019/0003657 | A1 | 1/2019 | Gross et al. | |
| 2019/0066504 | A1 | 2/2019 | Zaloom et al. | |
| 2019/0092225 | A1 | 3/2019 | Schermerhorn et al. | |
| 2019/0120469 | A1 | 4/2019 | Windom et al. | |
| 2019/0333353 | A1 * | 10/2019 | Siminoff | H04R 1/028 |

FOREIGN PATENT DOCUMENTS

| | | | |
|---|---|---|---|
| DE | 10 2018 002 765 | A1 | 10/2019 |
| DE | 10 2018 010 099 | A1 | 6/2020 |

* cited by examiner

HUMAN TRACKING TO PRODUCE IMPROVED JOBSITE LIGHTING

This application is a continuation application of U.S. patent application Ser. No. 16/840,668, filed on Apr. 6, 2020, the disclosure of which is hereby incorporated herein by reference in its entirety.

FIELD

The device and method disclosed in this document relates to lighting and, more particularly, to human tracking to produce improved jobsite lighting.

BACKGROUND

Unless otherwise indicated herein, the materials described in this section are not prior art to the claims in this application and are not admitted to the prior art by inclusion in this section.

Jobsites, such as indoor and outdoor construction sites or the like, often utilize temporary lighting in the form of work lights. Such work lights can be surface supported on a floor or work bench, but are also typically provided with threaded holes configured for attachment to a tripod stand or support pole. In any case, the work lights are statically placed and oriented and require periodic user interaction (i.e., movement or reorientation of the lights) to provide continued optimal illumination of the jobsite. The time required to reposition or reorient a work light is non-value-added work. In other words, this is work that is required to get a job done but does not add value to the finished product. Accordingly, what is needed is a work lighting system that minimized or eliminates the time and effort required to maintain optimal illumination of the jobsite.

SUMMARY

A work light for providing lighting in an environment is disclosed. The work light comprises a light fixture having a light. The light fixture is configured to direct lighting from the light in a first direction. The work light further comprises a mount configured to support the light fixture. The mount has at least one actuator configured to adjust an orientation of the light fixture so as to adjust the first direction in which the lighting is directed. The work light further comprises at least one sensor configured to provide sensor data of the environment. The work light further comprises a controller operably connected to the at least one sensor and the at least one actuator of the mount. The controller is configured to (i) determine a location of a target person in the environment based on the sensor data and (ii) operate the at least one actuator to adjust the orientation of the light fixture based on the location of the target person. The work light further comprises a battery that is operably connected to and provides operating power to (i) the light of the light fixture, (ii) the at least one actuator of the mount, (iii) the at least one sensor, and (iv) the controller.

A further work light for providing lighting in an environment is disclose. The work light comprises a light fixture having a light. The light fixture is configured to direct lighting from the light in a first direction. The work light further comprises a mount configured to support the light fixture. The mount has at least one actuator configured to adjust an orientation of the light fixture so as to adjust the first direction in which the lighting is directed. The work light further comprises at least one sensor configured to provide sensor data of the environment. The work light further comprises a controller operably connected to the at least one sensor and the at least one actuator of the mount. The controller is configured to (i) determine a location of a target person in the environment based on the sensor data and (ii) operate the at least one actuator to adjust the orientation of the light fixture such that the first direction in which the lighting from the light is directed points toward an offset location which is offset from the location of the target person.

BRIEF DESCRIPTION OF THE DRAWINGS

The foregoing aspects and other features of the portable work light are explained in the following description, taken in connection with the accompanying drawings.

DETAILED DESCRIPTION

Figure 1:
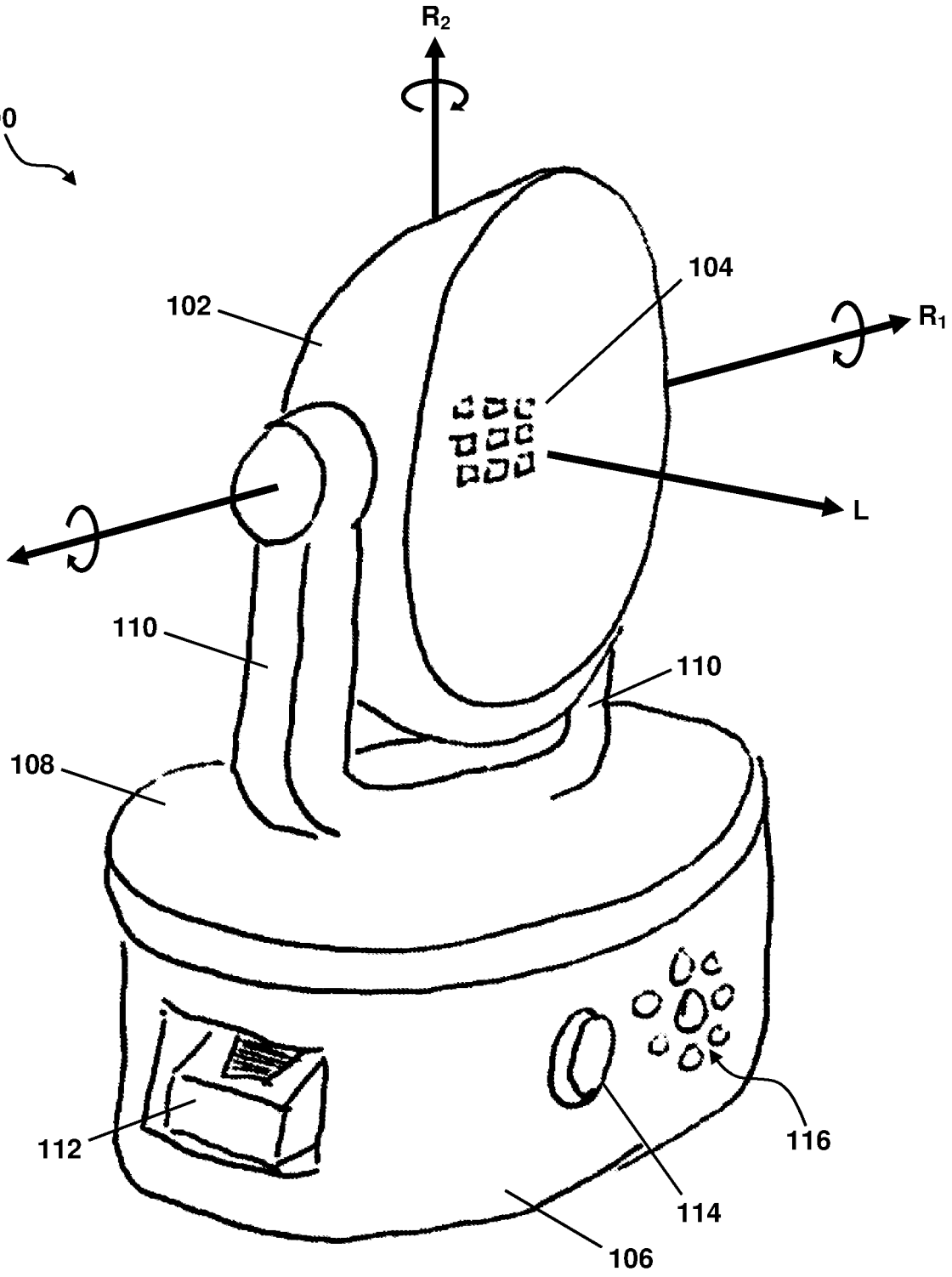
FIG. 1 shows a perspective view of a portable work light.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art which this disclosure pertains.

Portable Work Lighting System

Figure 2:
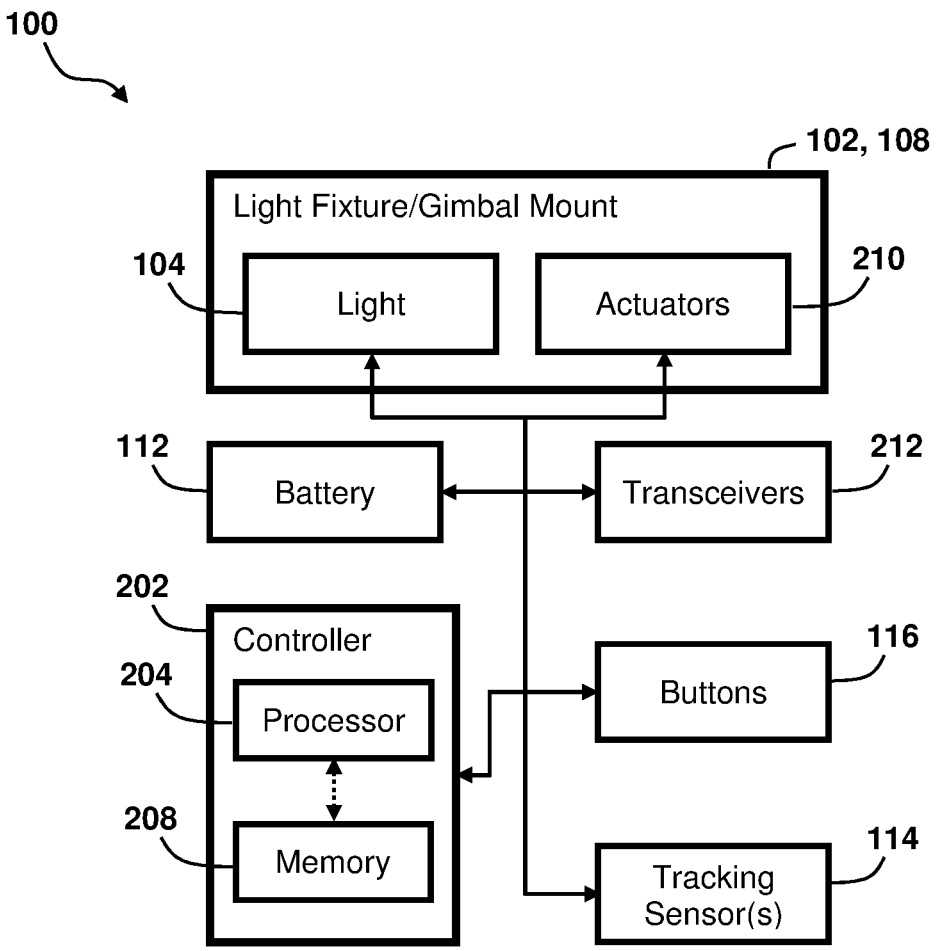
FIG. 2 shows a schematic diagram of the portable work light of FIG. 1.

FIGS. 1-2 show a portable work light 100 comprising a light fixture 102 having one or more rotational degrees of freedom that can be actuated such that a light 104 thereof can maintain optimal lighting for a target person in a jobsite environment. Particularly, the portable work light 100 is advantageously configured to track a target person's location within the jobsite environment and automatically reorient the light fixture 102 as needed to maintain optimal illumination of the jobsite for the target person. In this way, the non-value-added work of repositioning or reorienting the work light is eliminated, thus enhancing the productivity of the target person at the jobsite.

With reference to FIG. 1, an exemplary embodiment of the portable work light 100 is shown. The portable work light 100 comprises the light fixture 102, a base portion 106, and a gimbal mount 108. The light fixture 102 is configured to hold the light 104, which may comprise one or more LEDs, incandescent light bulbs, CFL light bulbs, or the like. The light fixture 102 has a shape configured to direct lighting provided by the light 104 in a lighting direction L. As used herein, the "lighting direction" refers to a direction extending from the light fixture 102 in which the lighting provided by the light 104 has a peak intensity. It will be appreciated, however, that the light 104 may nevertheless provide some amount of ambient light in other directions other than the lighting direction L. Moreover, it will be appreciated that the light fixture 102 may be configured to direct lighting in more than one lighting direction L.

The light fixture 102 is supported by a gimbal mount 108 which is attached to the base portion 106 and is configured to enable the light fixture 102 to rotate about one or more rotational degrees of freedom so as to adjust the lighting direction L. The gimbal mount 108 advantageously incorporates one or more actuators (shown in FIG. 2), such as electric motors or the like, that enable the light fixture 102 to be rotated about the one or more rotational degrees of freedom without manual intervention. In at least one embodiment, the gimbal mount 108 is configured to enable the light fixture 102 to rotate about at least two rotational degrees of freedom. In some embodiments, the gimbal mount 108 may be configured to provide one or more translational degrees of freedom, as well.

In the illustrated exemplary embodiment, the gimbal mount 108 includes arms 110 that support the light fixture 102. The light fixture 102 is rotatably attached to the arms 110 such that the light fixture 102 can be rotated about a first rotational axis $R_1$. Additionally, the gimbal mount 108 is rotatably attached to the base portion 106 such that the gimbal mount 108, as well as the light fixture 102, can be rotated about a second rotational axis $R_2$. The incorporated actuators of the gimbal mount 108 are suitably installed and configured to enable rotation of the light fixture 102 about the first rotational axis $R_1$ and about the second rotational axis $R_2$. As a result, the gimbal mount 108 enables reorientation of the light fixture 102 such that lighting provided by the light 104 can be directed in any desired lighting direction L. It will be appreciated, however, that the illustrated embodiment is merely exemplary and that any suitable alternative structures can be utilized to enable to light fixture 102 to be rotatable about one or more rotational degrees of freedom. Moreover, in some embodiments, non-gimbal mounts such as ball and socket type mounts may also be utilized.

The base portion 106 is in the form of a housing that holds a battery 112, a controller (shown in FIG. 2), and any other electronic components discussed herein. In at least one embodiment, the base portion 106 has a substantially flat bottom surface to enable the portable work light 100 to rest on a surface such as a floor or a workbench in a stable manner. In one embodiment, the bottom surface of the base portion 106 includes three or more elastomeric feet or equivalent to provide stability and grip. Additionally, in at least one embodiment, the base portion 106 includes threaded holes (not shown) configured for attachment to a tripod stand or support pole.

In at least one embodiment, the portable work light 100 further includes one or more tracking sensors 114 configured to enable the controller of the portable work light 100 to track a target person's location within the jobsite environment and automatically reorient the light fixture 102 as needed to maintain optimal illumination of the jobsite for the target person. In the illustrated embodiment, the tracking sensor(s) 114 are installed on an outer surface of the base portion 106. However, it will be appreciated that the particular manner of installation will depend on the type of sensors used for tracking the target person's location within the jobsite environment.

In some embodiments, the portable work light 100 includes at least one user interface configured to receive inputs from an operator, who may be the target person whose location is tracked or may be another person. Particularly, in the illustrated embodiment, the portable work light 100 includes a plurality of buttons 116. The plurality of buttons 116 may, for example, include a button for turning the portable work light 100 on and off, a button for turning the light 104 on and off, buttons for adjusting a brightness of the light 104, buttons for manually adjusting an orientation of the light fixture 102, and/or buttons for manually adjusting a lighting offset (discussed in greater detail below). The portable work light 100 may further include additional or alternative user interfaces, such as switches, display screens, speakers, or the like.

With reference to FIG. 2, exemplary electronic components of the portable work light 100 are shown. As mentioned above, the portable work light 100 includes a controller 202. The controller 202 comprises at least one processor 204 and associated memory 208. The memory 208 is configured to store program instructions that, when executed by the processor 204, enable the controller 202 to perform various operations described elsewhere herein, at least including tracking the location of the target person in the jobsite environment and adjusting the orientation of the light fixture 102 as needed to maintain optimal illumination of the jobsite for the target person. The memory 208 may be of any type of device capable of storing information accessible by the processor 204, such as a memory card, ROM, RAM, hard drives, discs, flash memory, or any of various other computer-readable medium serving as data storage devices, as will be recognized by those of ordinary skill in the art. Additionally, it will be recognized by those of ordinary skill in the art that a "processor" includes any hardware system, hardware mechanism or hardware component that processes data, signals or other information. The processor 204 may include a system with a central processing unit, graphics processing units, multiple processing units, dedicated circuitry for achieving functionality, programmable logic, or other processing systems.

The controller 202 is operably connected to actuators 210 and is configured to operate the actuators 210 to adjust the orientation of the light fixture 102 as needed to maintain optimal illumination of the jobsite for the target person. For example, with respect to the embodiment illustrated in FIG. 1, the controller 202 operates the actuators 210 to rotate the light fixture 102 about the first rotational axis $R_1$ and about the second rotational axis $R_2$. As noted above, the actuators 210 may comprise electric motors configured to rotate the light fixture 102 about the one or more degrees of freedom enabled by the gimbal mount 108. Accordingly, the electronic components of the portable work light 100 may include additional intermediate motor control or drive circuits (not shown) configured in a suitable manner for driving the electric motors.

The controller 202 is operably connected to the tracking sensor(s) 114 and configured to receive sensor data from the tracking sensor(s) 114. The tracking sensor(s) 114 are configured to directly capture sensor data or otherwise operate to enable in the collection of sensor data. As discussed in greater detail below, in some embodiments, the controller 202 is configured to receive and process the sensor data to determine the location of the target person in the jobsite environment.

In at least some embodiments, the portable work light 100 further includes one or more radio transceivers 212 configured to communicate with a portable electronic device (e.g., a smartphone or the like) in the possession of the target person or other operator, as well as in some cases a remote server (e.g., a cloud service) for the purpose of providing additional services. The radio transceiver(s) 212 may include a Bluetooth® configured to communicate locally with a smartphone or other portable electronic device in the possession of the target person or other operator Additionally, the radio transceivers(s) 212 may include transceivers configured to communicate with the Internet via a local network, such as a Wi-Fi transceiver, or transceivers configured to communicate with the Internet via wireless telephony network, such as Global System for Mobiles ("GSM") or Code Division Multiple Access ("CDMA") transceivers.

The controller 202 is operably connected to the plurality of buttons 116 or other user interfaces and configured to receive inputs from the target person or other operator via the plurality of buttons 116 or other user interfaces. In some embodiments, the controller 202 is configured to operate the actuators 210 to reorient the light fixture 102 in specified manner based on the inputs received the plurality of buttons 116 or other user interfaces. In some embodiments, the controller 202 is configured to control an on/off state of the light 104 based on the inputs received the plurality of buttons 116 or other user interfaces. In some embodiments, the controller 202 is configured to control a brightness of the light 104 based on the inputs received the plurality of buttons 116 or other user interfaces.

The battery 112 is operably connected to and configured to power the various components of the portable work light 100, at least including the light 104, the actuator(s) 210, the tracking sensor(s) 114, the transceivers 212, and the controller 202. In one embodiment, the battery 112 is a rechargeable battery configured to be charged when the portable work light 100 is connected to an external power source. While connected to external power, the various components of the portable work light 100 are powered by the external power source.

Human Tracking in the Jobsite Environment

The portable work light 100 is advantageously configured to track a target person's location within the jobsite environment. The location of the target person may be determined in absolute terms or in terms relative to the location of the portable work light 100. It should be appreciated that the portable work light 100 may be configured to perform the tracking of the target person's location using a wide variety of different techniques, some of which are described below.

In one embodiment, the portable work light 100 utilizes a vision-based tracking technique. Particularly, the tracking sensor(s) 114 may include a camera configured to capture a plurality of images of the jobsite environment. Based on the plurality of images captured by the camera, the controller 202 is configured to determine, on a continuous basis, the location of the target person in the jobsite environment. Each image captured by the camera may, for example, comprise a two-dimensional array of pixels. Each pixel has corresponding photometric information (e.g., intensity, color, and/or brightness). The photometric information may include red-green-blue (RBG) channel data and/or infrared (IR) channel data. In some embodiments, the camera is configured to generate RGB-D images in which each pixel has corresponding photometric information and geometric information (e.g., depth and/or distance). In such embodiments, the camera may, for example, take the form of two RGB cameras configured to capture stereoscopic images from which depth and/or distance information can be derived, and/or an RGB camera with an associated IR camera from which depth and/or distance information can be derived.

In one embodiment, the portable work light 100 utilizes an ultrasonic tracking technique. Particularly, the tracking sensor(s) 114 may include one or more ultrasonic transducers, each configured to emit an ultrasonic signal, i.e. a high-frequency sound wave, and then receive a reflected ultrasonic signal. The controller 202 is configured to determine one or more distance and/or a time of flight measurements based on a comparison of the emitted ultrasonic signals and the reflected ultrasonic signals. Based on the distance and/or a time of flight measurements, the controller 202 is configured to determine, on a continuous basis, the location of target person in the jobsite environment.

In one embodiment, the portable work light 100 utilizes a radar-based tracking technique. Particularly, the tracking sensor(s) 114 may include one or more radar antennas, each configured to transmit a radio signal, e.g. a high-frequency radio waves, and then receive a reflected radio signal. The controller 202 is configured to determine one or more distance and/or a time of flight measurements based on a comparison of the transmitted radio signals and the reflected radio signals. Based on the distance and/or a time of flight measurements, the controller 202 is configured to determine, on a continuous basis, the location of target person in the jobsite environment.

In one embodiment, the portable work light 100 utilizes a capacitance field-based tracking technique. Particularly, the tracking sensor(s) 114 may include one or more capacitive sensors, each being configured to detect the presence and/or location of the target person. Each capacitive sensor may, for example, comprise one or more electrodes coupled with a capacitance sensing circuit configured to detect changes in capacitance resulting from the target person moving throughout the jobsite environment. Based on the changes in capacitance at the one or more electrodes, the controller 202 is configured to determine, on a continuous basis, the location of target person in the jobsite environment.

In one embodiment, the portable work light 100 utilizes a radio triangulation/trilateration-based tracking technique. Particularly, in this case, the target person carries a portable electronic device that is configured to resolve its own location based on timing signals transmitted by the portable work light 100, as well as at least one other timing signal source. The portable electronic device may be a smart phone or the like, but also may be a power tool that is being used by the target person at the jobsite. To this end, the tracking sensor(s) 114 may include an antenna configured to broadcast a timing signal that is used by the portable electronic device to resolve its own location. In some embodiments, the antenna that broadcasts the timing signal may be an antenna of one of the transceivers 212. Thus, in this particular embodiment, the tracking sensor(s) 114 and the transceivers 212 are, at least in part, one and the same. For example, a Bluetooth transceiver may be utilized to broadcast the timing signal and to receive the determined location of the portable electronic device from the portable electronic device.

It will be appreciated that, in order to resolve the location of the portable electronic device by triangulation or trilateration, two timing signals must be received by the portable electronic device, each from a different source. Thus, a second timing signal source is required. In one embodiment, the second timing signal is provided by a different portable work light that is essentially similar to the portable work light 100. In another embodiment, some other jobsite aid, such as a jobsite radio, provides the second timing signal. In yet another embodiment, a cell tower of a wireless telephony network provides the second timing signal.

The controller 202 is configured to operate an antenna of the tracking sensor(s) 114 and/or the transceivers 212 to broadcast a timing signal. The controller 202 receives a message from the portable electronic device, e.g. via a Bluetooth data connection, which indicates the self-determined location of the portable electronic device. The controller 202 is configured to determine the location of the target person as the location of the portable electronic device indicated in the message.

Finally, in some embodiments, the portable work light 100 may rely entirely on a self-localization of the portable electronic device. For example, the portable electronic device may be configured to self-localize using a GPS transceiver or using visual odometry, localization, and mapping techniques (e.g., in the case that the portable electronic device is an augmented reality headset worn by the target person). In such embodiments, the controller 202 receives a message from the portable electronic device, e.g. via a Bluetooth data connection, which indicates the self-determined location of the portable electronic device. The controller 202 is configured to determine the location of the target person as the location of the portable electronic device indicated in the message.

Maintaining Optimal Lighting in the Jobsite Environment

Figure 3A:
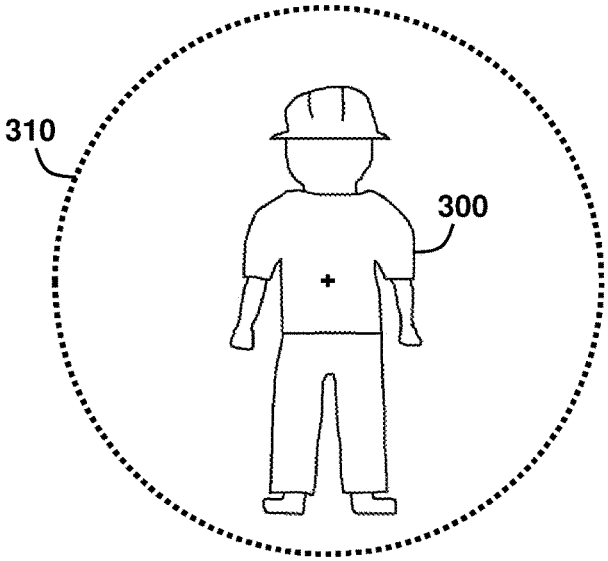
FIGS. 3A-3C illustrate exemplary techniques for maintaining optimal illumination of the jobsite for a target person.
Figure 3B:
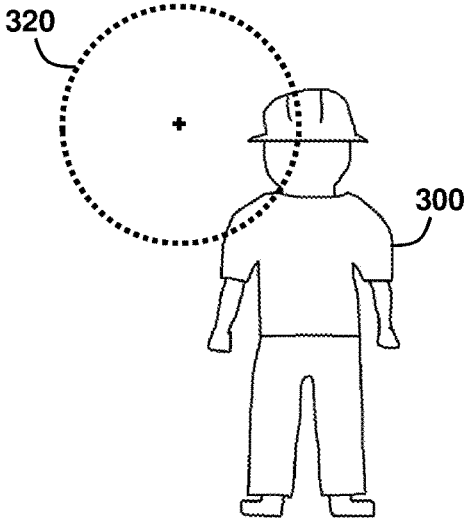
Figure 3C:
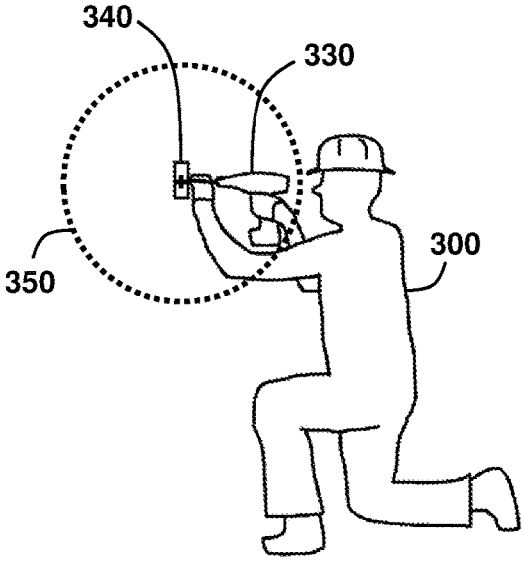

The portable work light 100 is advantageously configured to automatically adjust an orientation of the light fixture 102 as necessary to maintain optimal illumination of the jobsite for the target person. Particularly, the controller 202 is configured to operate the actuators 210 to adjust the orientation of the light fixture 102 based on the continuously determined location of the target person. In this way, the non-value-added work of repositioning or reorienting the portable work light 100 is eliminated, thus enhancing the productivity of the target person at the jobsite. FIGS. 3A-3C illustrate exemplary techniques for maintaining optimal illumination of the jobsite for the target person.

FIG. 3A shows a lighting technique in which the light fixture 102 is continuously adjusted to direct the lighting provided by the light 104 toward the determined location of the target person 300, which may correspond in particular to an estimated center of mass/volume of the target person. Thus, the portable work light 100 provides a lighted region 310 around the target person 300. In this way, as the target person 300 moves throughout the jobsite environment, the portable work light 100 continuously provides optimal lighting as the target person 300 to performs tasks in at jobsite, without the need for manually repositioning or reorienting the portable work light 100.

To this end, in at least one embodiment, the controller 202 is configured to operate the actuators 210 to adjust the orientation of the light fixture 102 such that the lighting direction L points toward the location of the target person 300. As the target person 300 moves throughout the jobsite environment, the controller 202 continuously determines an updated location of the target person 300 and operates the actuators 210 to adjust the orientation of the light fixture 102 to maintain lighting directed toward the updated location of the target person 300.

FIG. 3B shows a lighting technique in which the light fixture 102 is continuously adjusted to direct the lighting provided by the light 104 toward an offset location. The offset location is offset from the determined location of the target person 300 in a predetermined and adjustable manner. In the illustrated example, the lighting is directed so as to provide an offset lighted region 320 at an offset location located above the left shoulder of the target person 300. This may be useful, for example, if the target person intends to hammer a large number of nails into a wall and needs lighting above his or her left should in particular to best perform this task. In this way, as the target person 300 moves along the wall to hammer the large number of nails, the portable work light 100 continuously provides optimal lighting for the task, without the need for manual repositioning or reorienting the portable work light 100.

The particular manner in which the offset lighted region 320 is offset with respect to the continuously determined location of the target person is adjustable by the target person 300 or by another operator. Particularly, in the illustrated example, the offset lighted region 320 is located up and to the left relative to the determined location of the target person 300. However, any other directional offset can be utilized to provide optimal lighting for whatever task is being performed by the target person 300. In one embodiment, the offset is adjusted manually by pressing the buttons 116 of the portable work light 100. In another embodiment, the offset is adjusted via an application that runs on a portable electronic device (e.g., a smartphone or the like) carried by the target person or other operator.

To this end, in at least one embodiment, the controller 202 is configured to receive inputs from the buttons 116 or a message from the portable electronic device indicating a desired offset value that has been selected by the target person 300 or other operator. The desired offset value may, for example, take the form of a direction, distance, and/or vector that defines an offset location relative to the determined location of the target person 300. Once the desired offset value is selected and received, the controller 202 is configured to operate the actuators 210 to adjust the orientation of the light fixture 102 such that the lighting direction L points toward an offset location that is offset from the determined location of the target person 300 in the manner defined by the desired offset value. As the target person 300 moves throughout the jobsite environment, the controller 202 continuously determines an updated location of the target person 300 and operates the actuators 210 to adjust the orientation of the light fixture 102 to maintain lighting directed toward an offset location that is defined relative to the updated location of the target person 300.

FIG. 3C shows a lighting technique in which the light fixture 102 is continuously adjusted to direct the lighting provided by the light 104 toward an offset location which is automatically determined based on an action being performed by the target person. Particularly, in one embodiment, in addition to tracking the location of the target person, the portable work light 100 determines what the target person 300 is doing. Based on what the target person 300 is doing, the portable work light 100 determines an offset location that is most appropriate. In the illustrated example, the target person 300 is performing a task using a handheld power tool 330 on a workpiece 340. The portable work light 100 detects that the target person is performing such a task and directs the lighting so as to provide an offset lighted region 350 at an offset location that is centered on the workpiece 340 and/or at an interface between the power tool 330 and the workpiece.

To this end, the controller 202 is configured to detect various types of actions or poses that might be performed by the target person 300 based on sensor data received from tracking sensor(s) 114. The controller 202 may utilize a wide variety of techniques to detect the various types of actions or poses that might be performed by the target person 300. In at least one embodiment, the tracking sensor(s) 114 may include a camera configured to capture a plurality of images of the jobsite environment, as discussed in greater detail above. The controller 202 is configured to use pose detection techniques, facial recognition techniques, object recognition techniques, and other computer-vision techniques to detect the various types of actions or poses that might be performed by the target person 300. Based on the detected action or pose of the target person 300, the controller 202 is configured to automatically determine an optimal offset location for the detected action or pose. The controller 202 operates the actuators 210 to adjust the orientation of the light fixture 102 to maintain lighting directed toward the determined offset location.

In one embodiment, the controller 202 is configured process the sensor data to detect that the target person 300 is perform an action using a tool (e.g., the handheld power tool 330). In response to detecting that the target person 300 is perform an action using a tool, the controller 202 is configured to set the offset location at the location of the tool. Alternatively, the controller 202 is configured to set the offset location at a location depending on the particular type of tool. Particularly, in some embodiments, the controller 202 is configured to identify the type of tool based on the sensor data. For some types of tools (e.g., a drill with a short drill bit), the controller 202 sets the offset location as the location of the tool. For other types of tools (e.g., a drill with a very long drill bit), the controller 202 sets the offset location at an interface between the tool and a workpiece and/or surface that is being acted upon by the tool.

In another embodiment, the controller 202 is configured process the sensor data to detect that the target person 300 is performing an action with respect to a workpiece or surface (e.g., the workpiece 340). In response to detecting that the target person 300 is performing an action with respect to a workpiece or surface, the controller 202 is configured to set the offset location at a location of the workpiece or surface.

In another embodiment, the controller 202 is configured to process the sensor data to detect whether target person 300 is facing toward the portable work light 100. In response to detecting that the target person 300 is facing the portable work light 100, the controller 202 is configured to set the offset location at a location away from the face of the target person 300, so as to avoid shining the light directly into the face of the target person 300. In one embodiment, the controller 202 is configured to, in response to detecting that the target person 300 is facing the portable work light 100, set the offset location at a location corresponding to a nearby wall, ceiling, or floor. In this way, the portable work light 100 continues to provide diffuse ambient lighting for the target person 300 without blinding the target person 300.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A portable work light for providing lighting in an environment, the portable work light comprising:

a light fixture having a light, the light fixture configured to direct lighting from the light in a first direction;

a mount configured to support the light fixture, the mount having at least one actuator configured to adjust an orientation of the light fixture so as to adjust the first direction in which the lighting is directed;

at least one sensor configured to provide sensor data of the environment; and a controller operably connected to the at least one sensor and the at least one actuator of the mount, the controller being configured to (i) determine a location of a target person in the environment based on the sensor data and (ii) operate the at least one actuator to adjust the orientation of the light fixture based on the location of the target person.

2. The portable work light of claim 1, wherein the mount is configured to be removably attached to at least one of (i) a tripod stand and (ii) a support pole.

3. The portable work light of claim 1, wherein the mount has a flat bottom surface opposite the light fixture such that the portable work light is configured to rest on a surface.

4. The portable work light of claim 1, wherein the at least one sensor includes a camera configured to capture images of the environment, the controller being configured to determine the location of the target person based on the captured images.

5. The portable work light of claim 4, wherein the camera has image sensors configured to capture the images including both photometric information and geometric information, the controller being configured to determine the location of the target person based on both the photometric information and the geometric information.

6. The portable work light of claim 1, wherein the at least one sensor includes an ultrasonic sensor configured to emit an ultrasonic signal and receive a reflected ultrasonic signal, the controller being configured to determine the location of the target person based on the reflected ultrasonic signal.

7. The portable work light of claim 1, wherein the at least one sensor includes a radar sensor configured to emit a radar signal and receive a reflected radar signal, the controller being configured to determine the location of the target person based on the reflected radar signal.

8. The portable work light of claim 1, wherein the at least one sensor includes a capacitive sensor having at least one electrode, the controller being configured to determine the location of the target person based on changes in capacitance at the at least one electrode.

9. The portable work light of claim 1, wherein the at least one sensor includes at least one radio antenna, the controller being configured to (i) operate the at least one radio antenna to transmit a timing signal to a portable electronic device held by the target person and (ii) receive from the portable electronic device a message indicating the location of the portable electronic device, the controller being configured to determine the location of the target person as the location of the portable electronic device.

10. The portable work light of claim 1, wherein the controller is configured to operate the at least one actuator to adjust the orientation of the light fixture such that the first direction in which the lighting from the light is directed points toward the location of the target person.

11. The portable work light of claim 1, wherein the controller is configured to operate the at least one actuator to adjust the orientation of the light fixture such that the first direction in which the lighting from the light is directed points toward an offset location which is offset from the location of the target person.

12. The portable work light of claim 11 further comprising:

a user interface configured to receive inputs from an operator of the portable work light, the inputs indicating the offset location.

13. The portable work light of claim 11 further comprising:

a transceiver configured to communicate with a portable electronic device, the controller being configured to operate the transceiver to receive a message from the portable electronic device indicating the offset location.

14. The portable work light of claim 11, wherein the controller is configured to automatically determine the offset location depending on the sensor data.

15. The portable work light of claim 14, wherein the controller is configured to (i) detect an action performed by the target person based on the sensor data and (ii) set the offset location depending on the detected action.

16. The portable work light of claim 14, wherein the controller is configured to (i) detect a tool used by the target person based on the sensor data and (ii) set the offset location depending on the detected tool.

17. The portable work light of claim 16, wherein the controller is configured to set the offset location at one of (i) a location of the tool and (ii) a location of an interface between the tool and a surface being acted upon by the tool.

18. The portable work light of claim 14, wherein the controller is configured to (i) detect that a task is performed on a workpiece by the target person based on the sensor data and (ii) set the offset location at a location of the workpiece.

19. The portable work light of claim 14, wherein the controller is configured to (i) detect whether the target person is facing the portable work light and (ii) in response to detecting that the target person is facing the portable work light, set the offset location at a location away from the target person's face.

20. The portable work light of claim 19, wherein the controller is configured to, in response to detecting that the target person is facing the portable work light, set the offset location at a location corresponding to at least one of a wall, a ceiling, and a floor.

* * * * *